US010648237B2

(12) United States Patent
Campbell

(10) Patent No.: US 10,648,237 B2
(45) Date of Patent: May 12, 2020

(54) TORQUE GENERATOR

(71) Applicant: Charles Abernethy Anderson, Millarville (CA)

(72) Inventor: Josh Campbell, Calgary (CA)

(73) Assignee: Charles Abernethy Anderson, Millarville (CA)

( * ) Notice: Subject to any disclaimer, the term of this patent is extended or adjusted under 35 U.S.C. 154(b) by 107 days.

(21) Appl. No.: 15/902,023

(22) Filed: Feb. 22, 2018

(65) Prior Publication Data

US 2018/0252039 A1 Sep. 6, 2018

Related U.S. Application Data

(60) Provisional application No. 62/467,301, filed on Mar. 6, 2017.

(51) Int. Cl.

| | |
|---|---|
| ***E21B 4/16*** | (2006.01) |
| ***E21B 4/00*** | (2006.01) |
| ***E21B 4/02*** | (2006.01) |
| ***E21B 7/06*** | (2006.01) |

(52) U.S. Cl.

CPC ..... *E21B 4/16* (2013.01); *E21B 4/003* (2013.01); *E21B 4/02* (2013.01); *E21B 7/067* (2013.01)

(58) Field of Classification Search

CPC ... E21B 4/16; E21B 4/003; E21B 4/02; E21B 7/068; E21B 7/04; E21B 7/067

See application file for complete search history.

(56) References Cited

U.S. PATENT DOCUMENTS

| | | | | |
|---|---|---|---|---|
| 8,381,839 | B2 | 2/2013 | Rosenhauch | |
| 9,506,335 | B1 | 11/2016 | Smith | |
| 9,587,437 | B2 * | 3/2017 | Prill | E21B 10/26 |
| 9,771,757 | B2 * | 9/2017 | Marchand | E21B 4/02 |
| 9,771,787 | B2 | 9/2017 | Smith | |
| 2006/0237234 | A1 * | 10/2006 | Dennis | E21B 4/02 175/95 |
| 2013/0313022 | A1 * | 11/2013 | Kirkhope | E21B 4/02 175/104 |
| 2018/0003025 | A1 | 1/2018 | Smith | |

* cited by examiner

*Primary Examiner* — David J Bagnell
*Assistant Examiner* — Jonathan Malikasim
(74) *Attorney, Agent, or Firm* — Holzer Patel Drennan

(57) ABSTRACT

A torque generator for use in a bottom-hole assembly. The torque generator has a bearing pack rotationally coupled to a housing and a pump and one or more nozzles inside and supported by the housing. The one or more nozzles are in fluid communication with the pump chamber. The torque generator also has a bypass conduit extending through the pump and bypassing the pump and the one or more nozzles. The bypass conduit has a discharge end that is downhole from the pump and the one or more nozzles.

21 Claims, 11 Drawing Sheets

BD = Drill Bit Direction of Rotation
RT = Reactive Torque generated by Drill Bit Rotation
CT = Counter Torque generated by Torque Generator
DTF = Drill Tool Face

TORQUE GENERATOR

CROSS REFERENCE TO RELATED APPLICATION

This application claims priority to U.S. Provisional Patent Application No. 62/467,301, entitled "Method and Apparatus for Directional Drilling," filed Mar. 6, 2017, which is hereby incorporated by reference in its entirety.

FIELD

Embodiments herein are related in general to method and apparatus for directional drilling and more particularly to apparatus utilizing a bottom-hole assembly coupled with a torque device for controlling linear and nonlinear drilled segments of a borehole.

BACKGROUND

Directional drilling is well known in the art and commonly practiced. Directional drilling is generally practiced using a bottom-hole assembly connected to a drill string that is rotated at the surface using a rotary table or a top drive unit, each of which is well known in the art. The bottom-hole assembly includes a positive displacement drilling motor, turbine motor, or a pump that drives a drill bit via a "bent" housing that has at least one axial offset of around 1 to 3 degrees. A measurement-while-drilling (MWD) tool connected to the top of the drilling motor (sometimes also referred to herein as a "mud motor") provides "tool face" information to tracking equipment on the surface to dynamically determine an orientation of a subterranean bore being drilled. The drill string is rigidly connected to the bottom-hole assembly, and rotation of the drill string rotates the bottom-hole assembly.

To drill a linear bore segment, the drill string is rotated at a predetermined speed while drilling mud is pumped down the drill string and through the drilling motor to rotate the drill bit. The drill bit is therefore rotated simultaneously by the drilling motor and the drill string to drill a substantially linear bore segment. When a nonlinear bore segment is desired, the rotation of the drill string is stopped and controlled rotation of the rotary table or the top drive unit and/or controlled use of reactive torque generated by downward pressure referred to as "weight on bit" is used to orient the tool face in a desired direction. Drill mud is then pumped through the drill string to drive the drill bit, while the weight of the drill string supported by the drill rig is reduced to slide the drill string forward into the bore as the bore progresses. The drill string is not rotated while directional drilling is in progress.

However, this method of directional drilling has certain disadvantages. For example: during directional drilling the sliding drill string has a tendency to "stick-slip", especially in bores that include more than one nonlinear bore segment or in bores with a long horizontal bore segment; when the drill string sticks the drill bit may not engage the drill face with enough force to advance the bore, and when the friction is overcome and the drill string slips the drill bit may be forced against the bottom of the bore with enough force to damage the bit, stall the drilling motor, or drastically change the tool face, each of which is quite undesirable; and, rotation of the drill string helps to propel drill cuttings out of the bore, so when the drill string rotation is stopped drill cuttings can accumulate and create an obstruction to the return flow of drill mud, which is essential for the drilling operation. Furthermore, during directional drilling the reactive torque causes the stationary drill string to "wind up", which can also drastically change the tool face.

One solution to slip-slick related issues is set forth in U.S. Pat. No. 8,381,839 to Rosenhauch, the entirety of which is incorporated herein by reference. Therein, the bottom hole assembly is permitted to rotate independently of the drill string. When the bit is driven clockwise by the mud motor, reactive rotation of the bottom-hole assembly and bent sub is counterclockwise. A torque generator between the drill string and the bottom-hole assembly resists the reactive rotation. Rotation of the drill string at a static drive speed matches the reactive rotation of the bent sub and the net rotation of the bottom-hole assembly is zero so that the drill bit drills the nonlinear bore segment. Drill string rotation greater than the static drive speed results in a net clockwise rotation of the drill bit for drilling the linear bore segment. The torque generator comprises an arrangement of a modified positive displacement motor displacing fluid through a backpressure nozzle. The arrangement of the motor and the nozzles limits the peak torque available.

SUMMARY

According to a broad aspect of the present disclosure, there is provided a torque generator for use in a bottom-hole assembly comprising: a housing having a housing inner diameter; a bearing pack rotationally coupled to the housing, the bearing pack being connectable to a drill string and having a bearing pack bore extending therethrough for fluid communication with the drill string; a pump having a pump chamber, the pump being inside and supported by the housing; one or more nozzles inside and supported by the housing, uphole or downhole from the pump and in fluid communication with the pump chamber; and a bypass conduit extending through the pump and bypassing the pump and the one or more nozzles, and having an uphole end and a discharge end, the discharge end being downhole from the pump and the one or more nozzles.

According to another broad aspect of the present disclosure, there is provided a torque generator for use in a bottom-hole assembly connectable to a drill string, the torque generator comprising: a first assembly comprising: a bearing pack having a bearing sub and a bearing pack bore extending therethrough for fluid communication with the drill string, the bearing pack being connectable to the drill string; a crossover connected to a downhole end of the bearing pack and in communication with the bearing pack bore, the crossover having one or more passages for dividing fluid flowing therethrough into a torque generator flow and a bypass flow; a rotor having a rotor bore extending therethrough for passage of the bypass flow; and a tubular conduit connected to one end of the rotor and in fluid communication with the rotor bore; a second assembly comprising: a torque generator housing rotationally coupled to the bearing pack via the bearing sub; and a stator supported on the inner surface of the torque generator housing and having a diameter substantially the same as the inner diameter of the torque generator housing, and the rotor being positioned in the stator for operation therewith, wherein the torque generator housing assembly houses the crossover, the stator, the rotor, and the tubular conduit, wherein a pump chamber is defined between the rotor and the stator for passage of the torque generator flow, and wherein a nozzle annulus is defined between the torque generator housing and the tubular conduit; one or more annular walls in the nozzle annulus;

and one or more nozzles in each annular wall for controlling a fluid pressure of the torque generator flow passing therethrough.

BRIEF DESCRIPTION OF THE DRAWINGS

FIG. 1 is a schematic diagram of a bottom-hole assembly in accordance with one embodiment of the '839 patent;

FIG. 2 is a schematic diagram of another embodiment of a bottom-hole assembly in accordance with the invention of the '839 patent;

FIG. 3 is a schematic diagram of a reactive torque generator in accordance with one embodiment of the '839 patent;

FIG. 4 is a vector diagram schematically illustrating movement of a drill tool face when a drill string connected to a bottom-hole assembly of the '839 patent is not rotated as the drill bit is rotated by a mud motor of the bottom-hole assembly;

FIG. 5 is a vector diagram schematically illustrating drill tool face stability when the drill string connected to the bottom-hole assembly of the '839 patent is rotated at a static drive speed as the drill bit is rotated by the mud motor of the bottom-hole assembly;

FIG. 6 is a vector diagram schematically illustrating movement of the drill tool face when the drill string is rotated at a drill ahead speed as the drill bit is rotated by the mud motor of the bottom-hole assembly of the '839 patent;

FIG. 7 is a vector diagram schematically illustrating movement of the drill tool face when the drill string is rotated at an underdrive speed as the drill bit is rotated by the mud motor of the bottom-hole assembly of the '839 patent;

FIG. 8 is a flow chart illustrating principal steps of a first method of controlling the bottom-hole assembly shown in FIGS. 1-3 to drill a subterranean bore; and FIG. 9 is a flow chart illustrating principal steps of a second method of controlling the bottom-hole assembly shown in FIGS. 1-3 to drill a subterranean bore.

FIG. 10A is a general arrangement of the BHA having a drilling motor and a torque convertor depicted as a positive displacement motors;

FIG. 10B illustrates the drill string clockwise CW rotation as balanced to or equal to the reverse, counterclockwise CCW reactive rotation of the BHA, the net rotation of the bent sub being neutral or zero for non-linear drilling;

FIG. 10C illustrates the drill string clockwise CW rotation as greater than the reverse, counterclockwise CCW reactive rotation of the BHA, the net rotation of the bent sub being greater than neutral for effecting linear drilling;

FIG. 11A is an overall cross-sectional view of one embodiment of a bottom-hole assembly at a distal end of a rotary drill string; and FIG. 11B is a close up, cross section of the one bottom-hole assembly of FIG. 11A.

DETAILED DESCRIPTION OF THE PREFERRED EMBODIMENTS

As set forth in the '839 patent, the principle of a bottom-hole assembly (BHA) that rotates independently of the drill string, rotatably coupled through a torque generator, is provided for directional drilling of subterranean bore holes. As follows, the apparatus and the method of operation according to the '839 patent is first reproduced for establishing the basic principles of directional drilling with a reactive torque generator, and then embodiments of the current apparatus are introduced.

The '839 Patent

In the '839 patent, the BHA includes a torque generator with a driveshaft at its top end. The driveshaft is connected to a bottom end of a drill string. A housing of the torque generator is connected to a bearing assembly that surrounds the driveshaft and permits the BHA to rotate independently with respect to the drill string and driveshaft. A measurement while drilling (MWD) unit, a bent sub, and a mud motor that turns a drill bit are rigidly connected to a bottom end of the torque generator housing. Rotation of the drill string rotates the driveshaft, which induces the torque generator to generate a torque that counters a reactive torque generated by the mud motor as it turns the drill bit against a bottom of the bore hole. By controlling the rotational speed of the drill string, the bottom-hole assembly can be controlled to drill straight ahead, i.e. a linear bore segment, or directionally at a desired drill tool face, i.e. a non-linear bore segment, to change an azimuth and/or inclination of the bore path. Continuous rotation of the drill string facilitates bore hole cleaning, eliminates slip stick, and improves rate of penetration (ROP) by promoting a consistent weight on the drill bit. The BHA provides a simple all mechanical system for directional drilling that does not require complex and expensive electro-mechanical feedback control systems. The torque generator also acts as a fluid damper in the BHA that provides a means of limiting torque output of the drilling motor such that the damaging effects of stalling the drilling motor may be avoided.

Figure 1:
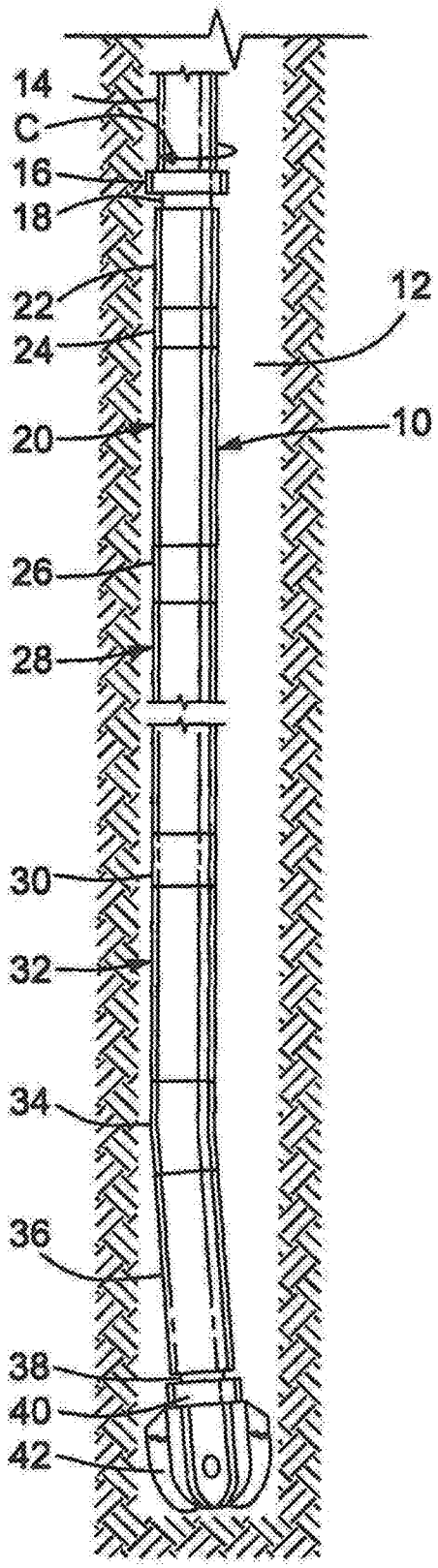
Fig. 1 PRIOR ART
FIGS. 1 through 9 illustrate the prior art method and apparatus set forth in issued U.S. Pat. No. 8,381,839 (the '839 patent). More particularly.

FIG. 1 is a schematic diagram of a BHA 10 in accordance with one embodiment of the invention of the '839 patent, shown in the bottom of a bore hole 12. The BHA 10 is connected to a drill string 14 (only a bottom end of which is shown) by a driveshaft connector 16. In one embodiment the driveshaft connector 16 is similar to a bit-box connection, which is well known in the art. The drill string 14 is rotated in a clockwise direction "C" by a rotary table (not shown) or a top drive unit (not shown), both of which are well known in the art. A driveshaft 18 of a torque generator 20 is rigidly connected to the driveshaft connector 16, so that the driveshaft 18 rotates with the drill string 14. A torque generator bearing section 22 surrounds the driveshaft and supports thrust and radial bearings through which the driveshaft 18 extends. The torque generator bearing section 22 is rigidly connected to a flex coupling housing 24 that is in turn rigidly connected to the torque generator 20, as will be explained below in more detail with reference to FIG. 3. The torque generator 20 may be any positive displacement motor that will generate a torque when the driveshaft 18 is turned by the drill string 14. In one embodiment the torque generator 20 is a modified progressive cavity pump, as will be explained in more detail below with reference to FIG. 3. A mud flow combination sub 26 is rigidly connected to a bottom end of the torque generator 20, as will likewise be explained below in more detail with reference to FIG. 3.

Rigidly connected to the bottom of the mud flow combination sub 26 is a measurement while drilling (MWD) unit 28, many versions of which are well known in the art. The MWD 28 may be capable of providing data only when the MWD 28 is rotationally stationary; in which case it is used to provide drill tool face orientation and take bore hole orientation surveys. Alternatively, the MWD 28 may be capable of providing both azimuth and inclination data while rotating; in which case it can be used to implement an automated drilling control system which will be explained below in more detail. The MWD 28 is rigidly connected to a dump sub 30, which dumps drilling mud from the drill string 14 as required, in a manner well known in the art. Rigidly connected to a bottom of the dump sub 30 is a conventional positive displacement motor (mud motor) 32 that drives a drill bit 42 as drilling mud (not shown) is pumped down the drill string 14 and through the mud motor 32.

Rigidly connected to a bottom end of a power section of the mud motor 32 is a bent housing 34 that facilitates directional drilling by offsetting the drill bit 42 from the axis of the drill string 14. The axial offset in the bent housing 34 is generally about 1.5° to 4°, but the bend shown is exaggerated for the purpose of illustration. The bent housing 34 surrounds a flex coupling (not shown) that connects a rotor of the mud motor 32 to a drill bit driveshaft 38. The drill bit driveshaft 38 is rotatably supported by a bearing section 36 in a manner well known in the art. Connected to a bottom end of the drill bit driveshaft 38 is a bit box 40 that connects the drill bit 42 to the drill bit driveshaft 38. The drill bit 42 may be any suitable earth-boring bit.

Figure 2:
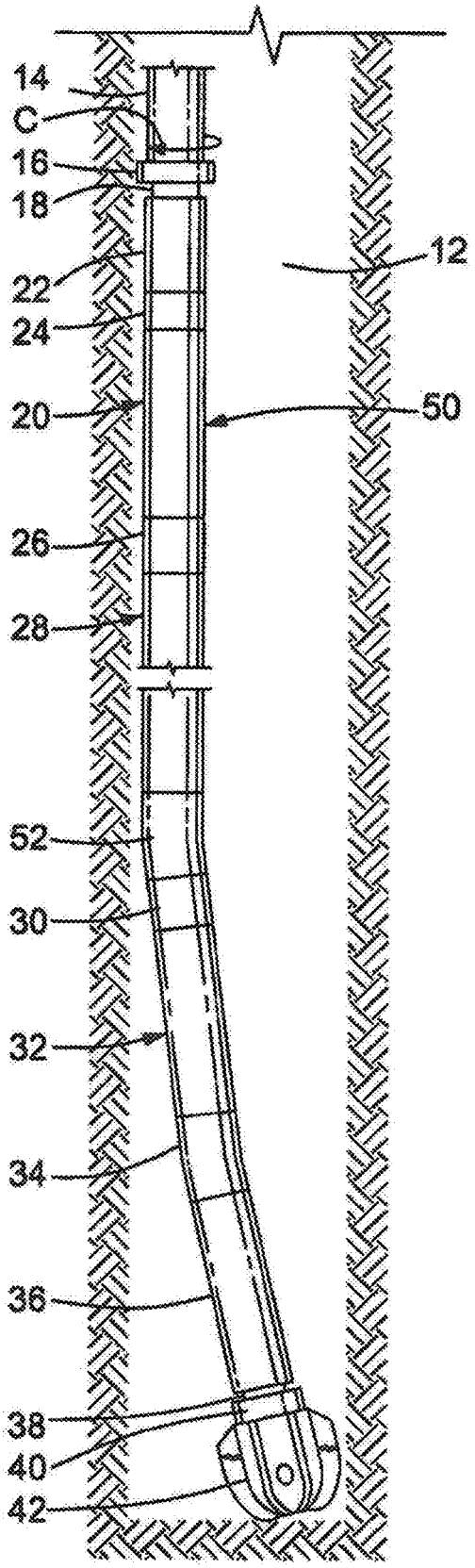
Fig. 2 PRIOR ART

FIG. 2 is a schematic diagram of another embodiment of a BHA 50 in accordance with the invention of the '839 patent. The BHA 50 is identical to the BHA 10 described above except that it includes a bent sub 52 between the MWD 28 and the dump sub 30 to provide yet more axial offset for the drill bit 42. The bent sub 52 is useful for boring tight radius curves, which can be useful, for example, to penetrate a narrow hydrocarbon formation.

Figure 3:
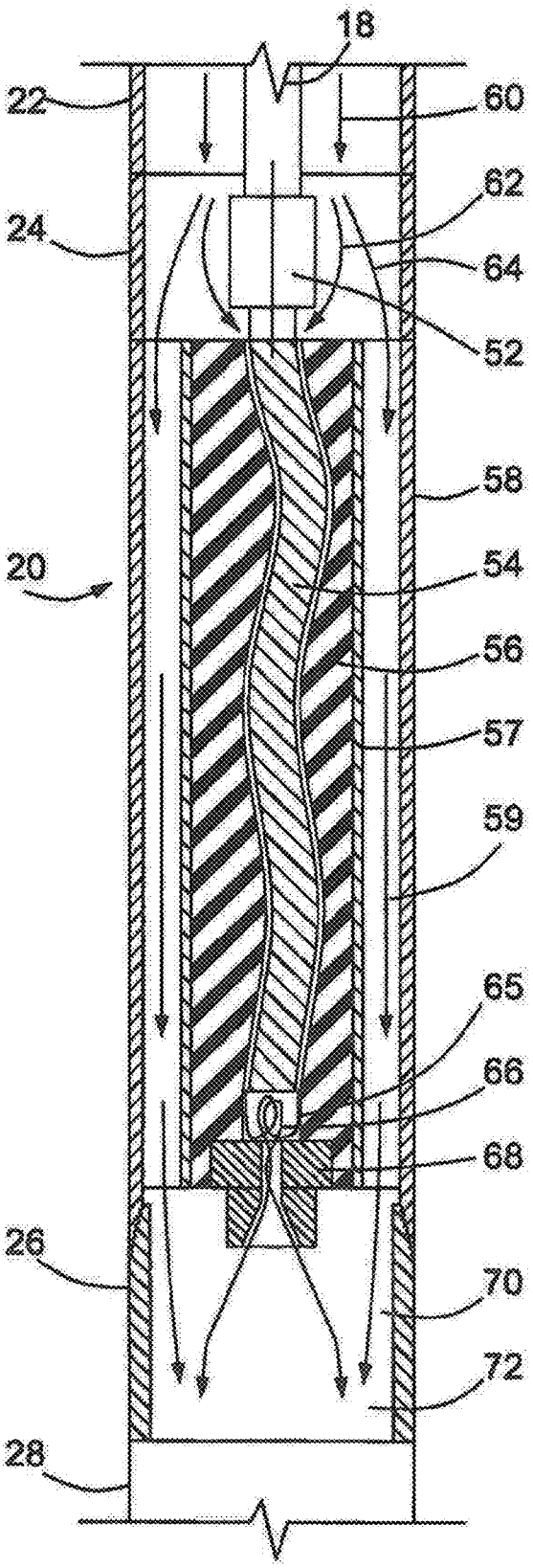
Fig. 3 PRIOR ART

FIG. 3 is a schematic cross-sectional diagram of one embodiment of the torque generator 20 in accordance with the invention of the '839 patent. In this embodiment the torque generator 20 is a modified progressive cavity pump, as will be explained below in detail. However, it should be understood that the torque generator 20 may be any modified positive displacement motor (e.g., a gear pump, a vane pump, or the like). It is only important that: a driveshaft of the torque generator 20 can be connected to and driven by the drill string 14 (FIG. 1) and the torque generator 20 outputs a consistent torque when the drill string 14 rotates the driveshaft of the torque generator 20 at a given speed, i.e. at a given number of revolutions per minute (RPM) hereinafter referred to as "static drive speed". It is also important that the torque output by the torque generator 20 be more than adequate to counteract a reactive torque generated by the drill bit 42 when drilling mud is pumped through the mud motor 32 at a predetermined flow rate to rotate the drill bit 42 against a bottom of the bore hole 12 under a nominal weight on bit (WOB).

Thus, the torque generator 20 permits directional drilling while the drill string is rotated at the static drive speed because the BHA 10 is held stationary by the torque generator 20 while the drill bit 42 is rotated by the mud motor 32 to drill a curved path (non-linear bore segment) with a stable drill tool face. This has several distinct advantages. For example: slip stick is eliminated because the rotating drill string 14 is not prone to sticking to the sides of the bore hole; consistent weight-on-bit is achieved because slip stick is eliminated; and, bore hole cleaning is significantly enhanced because the rotating drill string facilitates the ejection of drill cuttings, especially from long horizontal bore runs. If straight ahead (linear bore segment) drilling is desired, the drill string is rotated at a rotational speed other than the static drive speed, which rotates the entire BHA 10, 50 in a way somewhat similar to a conventional directional drilling BHA when it is used for straight ahead drilling.

Furthermore, straight ahead drilling can be accomplished while rotating the drill string 14 at only a marginally lower RPM or a marginally higher RPM (e.g., static drive speed −/+ only 5-10 RPM), because the drill string 14 is always rotated at a high enough RPM to eliminate slip stick and facilitate bore hole cleaning. Consequently, rotation-induced wear and fatigue on the BHA 10 can be minimized. However, it is recommended that straight ahead drilling be accomplished by rotating the drill string 14 at least about +5-10 RPM faster than the static drive speed because the BHA 10, 50 is then rotated clockwise and ROP is improved.

As shown in FIG. 3, the driveshaft 18 of the torque generator 20 is connected by a flex coupling 52 to a progressive cavity pump rotor 54, which is surrounded by a progressive cavity pump stator 56 in a manner known in the art. A casing 57 around the stator 56 is spaced inwardly by stays or spokes (not shown) from the housing 58 of the torque generator 20 to form a torque generator bypass annulus 59 (hereinafter bypass annulus 59). During a drilling operation, drilling mud 60, which is pumped down through the drill string 14 and the BHA 10 to drive the mud motor 32, is split in the flex coupling housing 24 into two separate flows; namely, a torque generation flow 62 that is drawn in by the rotor 54, and a bypass flow 64 that flows through the bypass annulus 59. The torque generation flow 62 is pumped into a compression chamber 65 where it becomes a compressed mud flow 66 that is forced through one or more nozzles 68. The nozzle(s) 68 may be specially designed, or one or more standard bit jet nozzles arranged in series or parallel to control the fluid pressure of the compressed mud flow 66.

The nozzle(s) 68 are selected at the surface before running the BHA 10 into the well. The selection of the nozzle(s) 68 is based on: an anticipated reactive torque generated by the mud motor 32 under a nominal weight-on-bit at an average formation density; a planned static drive speed for the drill string 14 during directional drilling and resulting counter torque generation at the planned static drive speed; and, an anticipated nominal mud density. The static drive speed of the drill string 14 induces the torque generator 20 to generate torque in a direction opposite the reactive torque generated by the mud motor 32 as it turns the drill bit 42 against the bottom of a bore hole. Consequently, the BHA 10 is rotationally stationary at the static drive speed and the drill tool face is stable, which permits directional drilling. Of course, the stability of the drill tool face is influenced by formation hardness, drilling mud density and drill bit design. However, weight-on-bit and/or the rotational speed of the drill string 14 are adjusted as required to compensate for any dynamic variations in drilling conditions to control the stability of the drill tool face during directional drilling.

After exiting the torque generator 20, the drilling mud flows 64 and 66 combine in a mixing chamber 70 of the mud flow combination sub 26 and the combined drilling mud flow 72 is forced down through the BHA 10 to power the mud motor 32 in a manner well known in the art.

Figure 4:
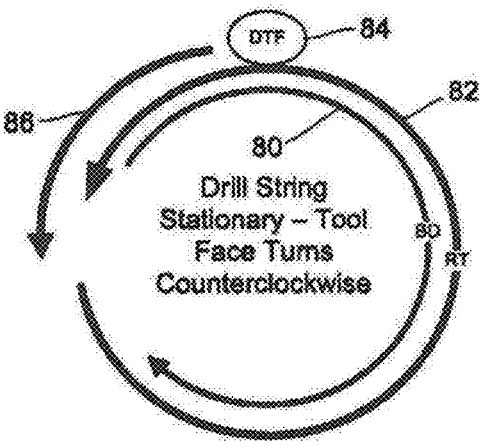
Fig. 4 PRIOR ART

FIG. 4 is a vector diagram schematically illustrating movement of drill tool face 84 if the drill string 14 connected to the BHA 10 is not rotated while the drill bit 42 is rotated by the mud motor 32, which is the mode of operation practiced during directional drilling with a conventional BHA. The mud motor 32 rotates the drill bit 42 in a clockwise direction 80 against a bottom of the well bore 12. The movement of the drill bit 42 generates a reactive torque 82. The reactive torque 82 urges the BHA 10 and the drill tool face 84 to rotate in a counterclockwise direction 86. When the drill string 14 is stationary, there is substantially no resistance to the reactive torque 82 because the driveshaft 18 of the torque generator 20 is not rotating and the torque generator 20 is not generating any counter torque. Consequently, the BHA 10 and the drill tool face 84 rotate counterclockwise as shown at 86. This is not a normal mode of operation for drilling with the BHA 10, and is shown simply to illustrate how the BHA 10 behaves if rotation of the drill string 14 is halted.

Figure 5:
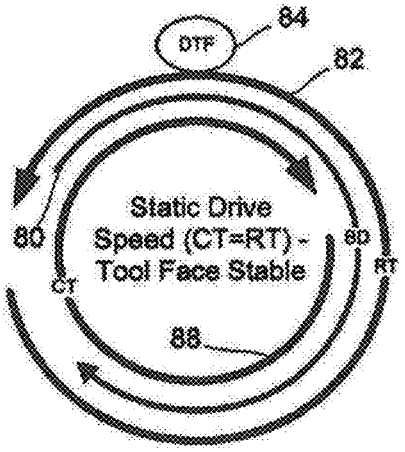
Fig. 5 PRIOR ART

FIG. 5 is a vector diagram schematically illustrating how the drill tool face 84 is stable when the drill string 14 is rotated at the static drive speed while the drill bit 42 is driven by the mud motor 32. At static drive speed a counter torque 88 generated by the torque generator 20 counterbalances the reactive torque 82 generated by the rotation of the drill bit 42. Consequently, the drill tool face 84 is stable and directional drilling is performed. If the formation hardness changes, or any other factor that influences the reactive torque changes, the static drive speed can be easily adjusted at the surface by controlling the rotational speed of the drill string 14 to keep the drill tool face 84 stable for as long as directional drilling is required. As explained above, the static drive speed is principally governed by the selection of the nozzle(s) 68 shown in FIG. 3. The static drive speed can be any convenient RPM within a rotational speed range of the rotary table or the top drive unit. Preferably, the static drive speed is fast enough to eliminate slip stick and promote efficient bore hole cleaning, e.g. around 60 RPM.

Figure 6:
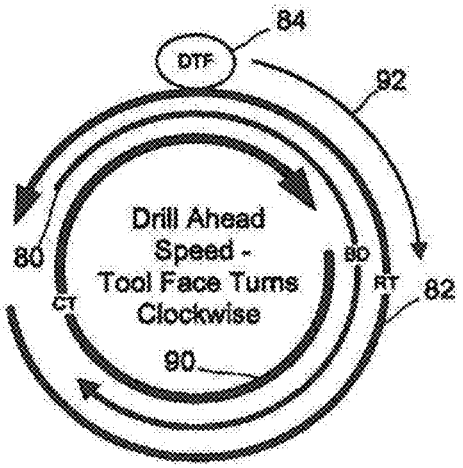
Fig. 6 PRIOR ART

FIG. 6 is a vector diagram schematically illustrating movement of the drill tool face 84 when the drill string 14 is rotated at "drill ahead" speed (e.g. the static drive speed plus at least several RPM). At drill ahead speed, counter torque 90 generated by the torque generator 20 is greater than the reactive torque 82 generated by rotation of the drill bit 42. Since the counter torque is greater than the reactive torque, the BHA 10 and the drill tool face 84 are rotated clockwise. In short applications, drill ahead speed can be used to adjust the drill tool face 84 to set up for directional drilling or to realign the drill tool face 84 during directional drilling. However, drill ahead speed is also used to drill a linear bore segment. Continuous application of drill ahead speed constantly rotates the drill tool face in the clockwise direction, which causes the BHA 10 to drill a linear bore segment from any starting azimuth and inclination. As explained above, the only limits on the drill ahead speed are: a maximum drive speed of the rotary table or the top drive unit; and/or, a manufacturer recommended maximum rotational speed of the BHA 10. Consequently, if the static drive speed is set at about 60 RPM and the BHA 10 is rated for up to about 60 RPM, the drill ahead speed could be as high as 120 RPM, provided the rotary table or the top drive unit is capable of rotating the drill string 14 at that rotational speed. It has been observed that bore hole cleaning is significantly improved by drill string rotational speeds of at least about 90 RPM.

Figure 7:
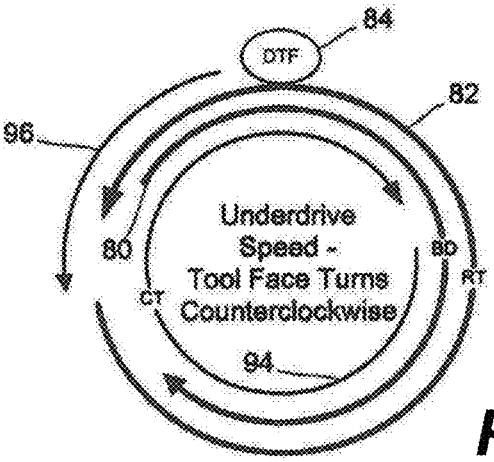
Fig. 7 PRIOR ART

FIG. 7 is a vector diagram schematically illustrating movement of the drill tool face 84 when the drill string 14 is rotated at an "underdrive" speed (e.g. the static drive speed minus at least several RPM). The underdrive speed can be optionally used for straight ahead drilling. Generally, the underdrive speed is only used in short applications to adjust the drill tool face 84 to set up for directional drilling or to realign the drill tool face 84 during directional drilling. When the drill string 14 is rotated at underdrive speed, the counter torque 94 is less than the reactive torque 82. Consequently, the BHA 10 and the drill tool face 84 are rotated in a counterclockwise direction by the reactive torque 82, opposite the direction of rotation of the drill string 14 and the drill bit 42.

Figure 8:
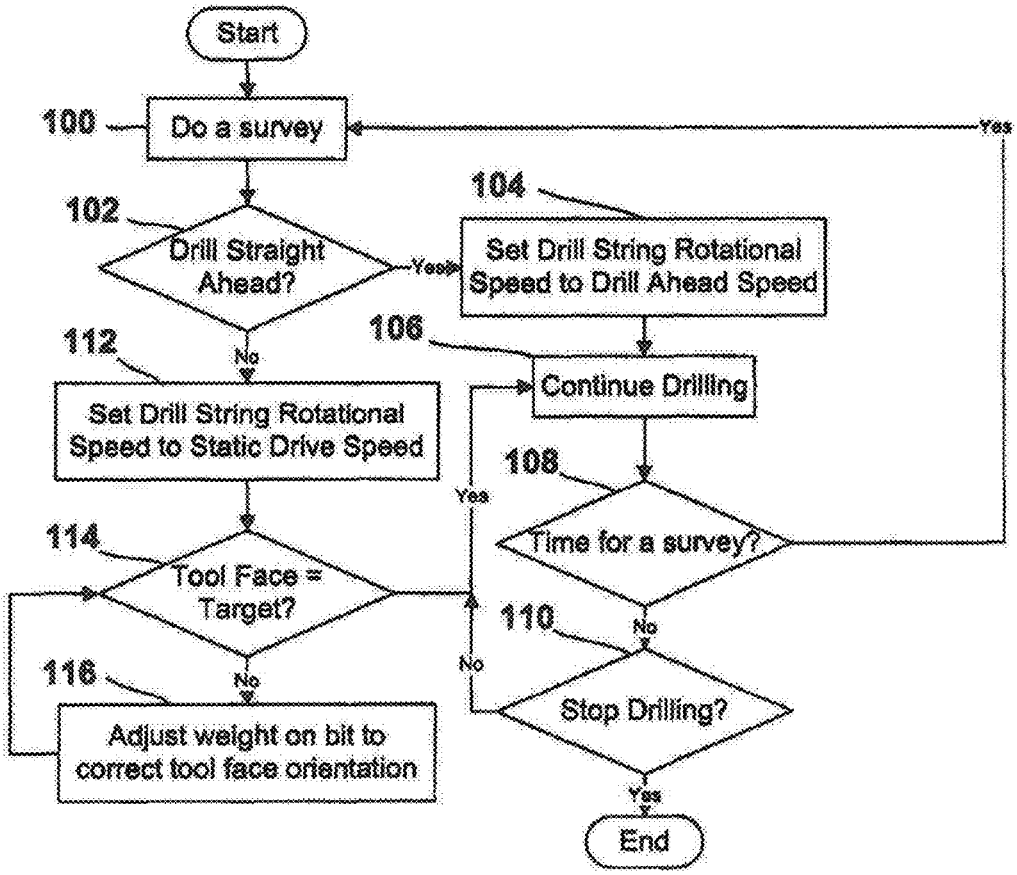
Fig. 8 PRIOR ART

FIG. 8 is a flow chart illustrating one method of drilling a bore hole using the BHA 10 or 50 in accordance with the invention of the '839 patent. The method shown in FIG. 8 follows the traditional method of directional drilling in which weight-on-bit is manipulated by a drill rig operator to orient the drill tool face 84 for directional drilling. As is standard practice with most MWD units 28, the drill string is stopped to perform a bore hole survey (100). The bore hole survey provides an azimuth and an inclination of the bore hole, which together provide a latest update on the actual bore path. The actual bore path is then compared with a well plan, and it is decided (102) if the bore hole should be drilled "straight ahead", i.e. a linear continuation of the current azimuth and inclination. If so a rotary table or top drive unit is controlled to drive (104) the drill string rotational speed at the drill ahead speed, e.g. the static drive speed plus at least several RPM.

After the drill string 14 is driven at drill ahead speed, the BHA 10 will elongate the bore hole linearly from a current azimuth and inclination as drilling continues (106). However, periodic surveys are made to ensure that the bore hole proceeds in accordance with the well plan. It is therefore determined (108) if it is time to do a survey. If so, the survey is done (100). If not, it is determined (110) if it is time to stop drilling. If not, the drilling continues (106) until it is time to do another survey, or it is time to stop drilling.

If it is determined (102) that the well bore should not be drilled straight ahead, i.e. directional drilling is required, the rotary table or the top drive unit is controlled to set (112) the drill string rotational speed to the static drive speed for directional drilling, as explained above. It is then determined (114) by comparing the survey data with the well plan if the current drill tool face 84 corresponds to a tool face target required for the directional drilling. If not, the weight on the drill bit is controlled by the operator (116) in a manner known in the art to adjust the drill tool face 84 to conform to the tool face target. This is a manual procedure that is learned from experience. Since the drill tool face 84 is stable at static drive speed under nominal weight on bit, the operator can manipulate the weight on the drill bit to adjust the drill tool face 84. For example, increasing the weight on bit will induce more reactive torque and cause the drill tool face 84 to rotate counterclockwise, while decreasing the weight on bit will reduce the reactive torque, and the torque generator will rotate the drill tool face 84 clockwise. When the drill tool face 84 corresponds with the target tool face the operator restores the nominal weight on bit and drilling proceeds (106) until it is determined (108) if it is time for another survey or it is determined (110) that it is time to stop drilling.

Figure 9:
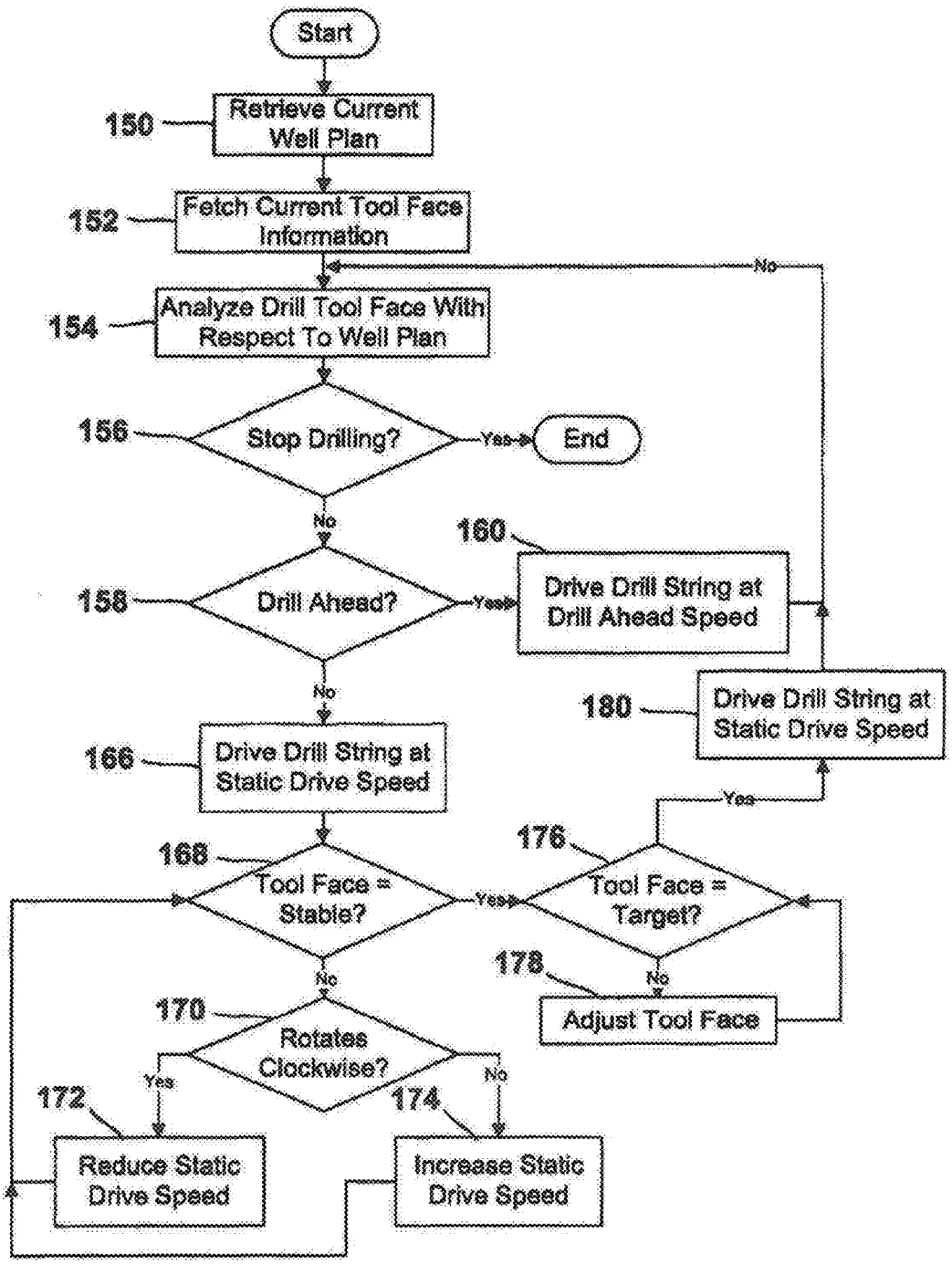
Fig. 9 PRIOR ART

FIG. 9 is a flow chart illustrating principal steps in a fully automated method of drilling a bore hole using the BHA 10 in accordance with the invention of the '839 patent. This method is practiced using a computer control unit (not shown) that is adapted to store an entire well plan and to autonomously control the speed of rotation of the drill string 14 using drill tool face information dynamically provided by the MWD unit 28.

As shown in FIG. 9, at startup the control unit retrieves (150) a well plan previously input by an operator. The control unit then fetches (152) current drill tool face information and analyzes (154) the current drill tool face with respect to the well plan that was retrieved (150). The control unit then determines (156) if it is time to stop drilling. If so, the process ends. If not, the control unit determines (158) if the well plan calls for drilling ahead (i.e. drilling a linear bore segment from a current azimuth and inclination). If so, the control unit sets (160) the rotational speed of the drill string 14 to drive ahead speed, and the process repeats from (154). If it is determined (158) that directional drilling is required, the control unit sets (166) the rotational speed of the drill string 14 to a current (last used) static drive speed. If drilling has just commenced or just resumed, a default static drive speed input by the operator is used. The control unit then uses MWD feedback to determine (168) if the drill tool face 84 is stable. If not, the drill tool face 84 must be stabilized.

An unstable drill tool face 84 at the static drive speed can occur for any of a number of reasons that influence the reactive torque 82, such as: an operator increase of the weight on bit; a change in the formation hardness; a change in the density of the drilling mud; etc. In order to stabilize the drill tool face 84, the control unit determines (170) if the drill tool face 84 is rotating clockwise. If so the counter torque generated by the torque generator 20 is greater than the reactive torque 82. Consequently, the control unit incrementally reduces the static drive speed and again determines (168) if the drill tool face 84 is stable. If it is determined (170) that the drill tool face 84 is not rotating clockwise, the control unit incrementally increases (174) the static drive speed and again determines (168) if the tool face is stable. As soon as the drill tool face 84 is stable, the control unit determines (176) if the drill tool face 84 corresponds to the tool face target. If it is determined that the drill tool face 84 does not correspond to the tool face target, the control unit adjusts (178) the drill tool face. The control unit adjusts the drill tool face by marginally increasing (to rotate the drill tool face 84 clockwise) or decreasing (to rotate the drill tool face 84 anticlockwise) the current static drive speed for a short period of time. Concurrently, the control unit monitors the drill tool face 84 until the drill tool face 84 corresponds to the tool face target. The control unit then resumes (180) the current static drive speed set or confirmed at (166) and the process repeats from (154), as described above.

In order to keep the control unit as simple and reliable as possible, the drill operator retains control of the weight on bit. If the drill operator changes the weight on bit during directional drilling the drill tool face 84 will change and/or become unstable due to a resulting change in the reactive torque 82 generated by the mud motor 32. If so, the control unit will determine (168) that the drill tool face 84 has changed or is no longer stable. Consequently, the control unit will adjust (170)-(174) the static drive speed to compensate for the change in weight on bit and/or correct (176-178) the drill tool face 84 to correspond to the tool face target, as described above.

Current Embodiments

Depending on the particular drilling operation, the torque generator 20 of the '839 patent can be underpowered. As stated above for the '839 patent, it is also important that the torque output by the torque generator be more than adequate to counteract a reactive torque generated by the drill bit 42 when drilling mud is pumped through the drilling motor 32 at a predetermined flow rate to rotate the drill bit 42 against a bottom of the bore hole 12 under a nominal weight on bit (WOB). If not, then the static drive speed will not be consistent.

The torque generator counteracts reactive torque and generates torque necessary maintain the static drive speed. Under difficult drilling conditions, including a large WOB, the reactive torque can overwhelm the torque generator and the relative rotation of the BHA with respect to earth can be unpredictable. If the reactive rotation is not adequately resisted, then the transition to linear drilling can be uncertain or compromised.

Herein, a high torque, torque generator 220 is provided, with its torque generation capability limited only by the diameter of the BHA, which will be explained in detail hereinbelow. Reference numerals of the components herein are the same as assigned for like components of the '839 patent and new reference numerals are provided for differing components.

In one aspect, the torque generator has a pump connected to a crossover assembly in a housing of the bottom-hole assembly. The pump maximizes the cross-sectional area of the housing for maximal torque generation. In this embodiment, the crossover assembly receives drilling fluid from the drill string and divides the flow of the drilling fluid to bypass some drilling fluid from the pump. The remaining drilling fluid passes through the pump and through nozzles to join the bypassed drilling fluid and the recombined drilling fluid is supplied to the drilling motor in the bottom-hole assembly.

In another aspect, the pump is a modified positive displacement motor or progressive cavity pump having a rotor fit to a stator supported by the bottom-hole assembly housing. The rotor diameter is maximized for maximal torque generation and the rotor is fit with a through bore for bypassing drilling fluid past the pump. The remaining drilling fluid passes through the pump and discharges into a nozzle annulus. One or more nozzles are provided in parallel or in series in the nozzle annulus for providing backpressure on the pump to set the planned static drive speed.

Figure 11A:
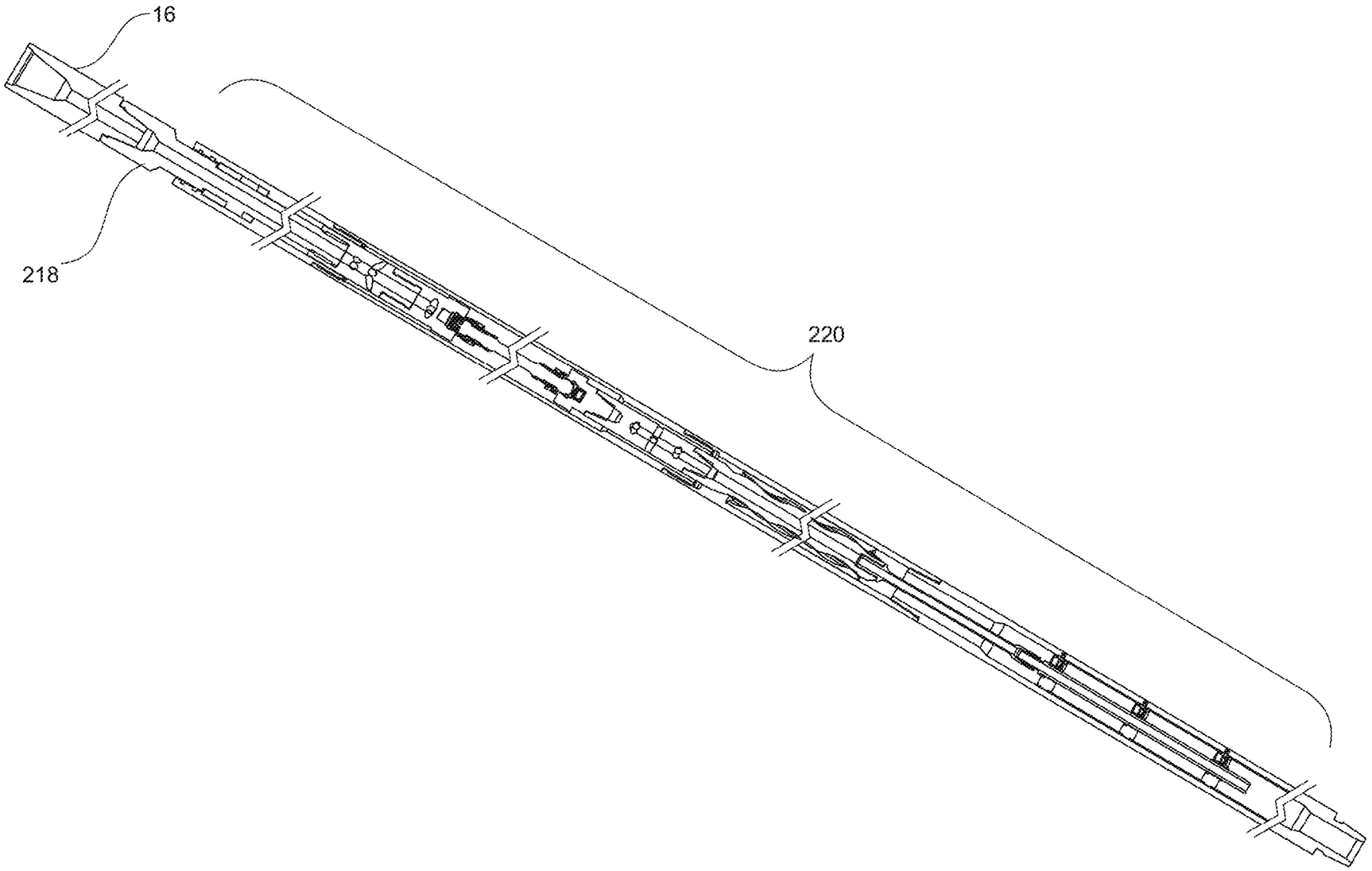
FIGS. 11A and 11B are cross sectional drawings of one embodiment of an alternate torque generator adapted to the BHA of the '839 patent for producing high resistive torque. More particularly.
Figure 11B:
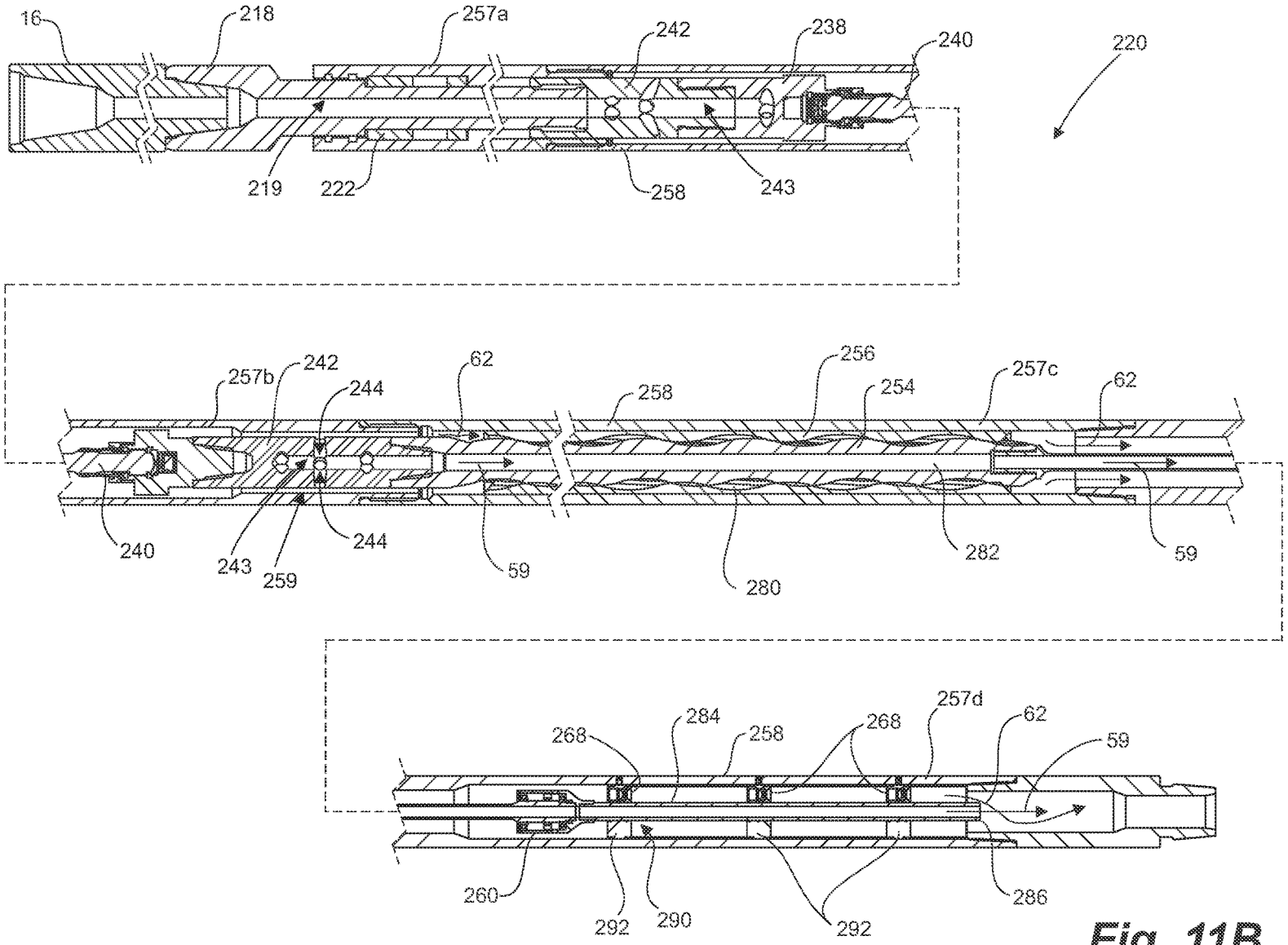

In the embodiment of FIGS. 11A and 11B, the torque generator 220 comprises a positive displacement motor or progressive cavity pump having a rotor 254 and a stator 256. The diameter of the stator 256 is maximized within the torque generator housing 258. In other words, the diameter of the stator 256 is the same or about the same as the inner diameter of the torque generator housing 258. Since the diameter of stator 256 is maximized, the average diameter of rotor 254 can be increased within the stator 256, in comparison with the stator 54 of the '839 patent. A pump chamber 280 is formed along the inner surface of the stator 256 and the rotor 254.

Unlike the torque generator 20 of the '839 patent, there is no annulus between the stator and the torque generator housing in the torque generator 220 for bypass flow 59 to flow. Instead, rotor 254 has a central bore 282 extending therethrough to provide a passage for bypass flow 59. Since there is no annulus between the stator 256 and the torque generator housing 258, the diameter of the rotor and/or stator in the torque generator 220 can thus be maximized for maximal torque generation.

Figure 10A:
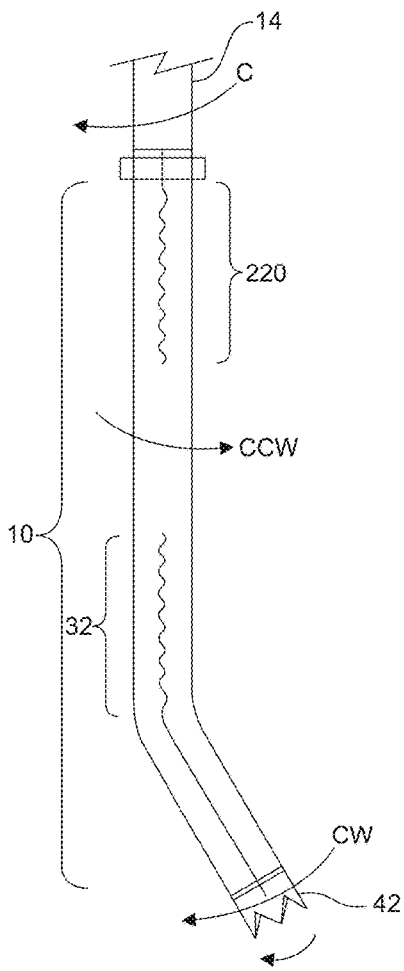
FIGS. 10A, 10B and 10C are schematic drawings of a bottom-hole assembly located at a distal end of a rotary drive string, the BHA having a drill bit powered by a drilling motor, and the BHA rotatable independent of the drill string, the rotation of which being controlled by a torque generator. More particularly.

In the embodiment of FIGS. 10A, 11A, and 11B, the torque generator 220 generally comprises two assemblies: a first assembly for coupling with the drill string and for rotation in a first direction (e.g. CW rotation); and a second assembly having the torque generator housing 258 for rotation in a second direction, opposite to the first direction (e.g. CCW rotation). When drilling fluids are distributed from the drill string 14 to torque generator 220, the torque generator 220 supplies the drilling motor 32 with drilling fluids to drive the drill bit in a CW direction.

The first assembly, from the uphole end adjacent the driveshaft connector 16, comprises a bearing pack 218 having a bearing sub 222 for rotational coupling with the torque generator housing 258 and a central bore 219 extending therethrough for receiving drilling fluids from the drill string 14 via connector 16. Connected to the downhole end of the bearing pack 218 is a crossover unit 242 which is a sub having a central bore 243 extending therethrough and in fluid communication with the bearing pack bore 219. The crossover 242 is fit with one or more radial passages 244 for directing some drilling fluid from the bore 243 to a housing annulus 259 defined between the crossover 242 and the housing 258. The crossover 242 can thus divide drilling fluids flowing therethrough into two flows: a torque generator flow 62 through passages 244 and a bypass flow 59 through bore 243.

In some embodiments, the crossover includes a splitter 238 in an uphole portion of the crossover for reducing the velocity of the fluid entering the crossover bore 243 from the bearing pack bore 219. The crossover may further include a driveshaft 240 for connecting splitter 238 to the downhole portion of the crossover, for example where the passages 244 are situated. The driveshaft 240 transmits torque from the splitter to the downhole portion of the crossover.

The crossover 242 is connected to the uphole end of the rotor 254 for transmitting torque from the bearing pack 218 to the rotor 254. The crossover bore 243 is in communication with the rotor bore 282 for supplying drilling fluids (i.e. bypass flow 59) thereto. The housing annulus 259 is fluidly contiguous with the pump chamber 280 for supplying torque generator flow 62 thereto. The rotation of the drill string rotates the bearing pack, the crossover, and the rotor. The rotation of the rotor 254 within the stator 256 generates negative pressure in the pump chamber 280 which helps draw or pump the torque generator flow 62 out of the crossover bore via passages 244 and into the pump chamber 280.

Figure 12A:
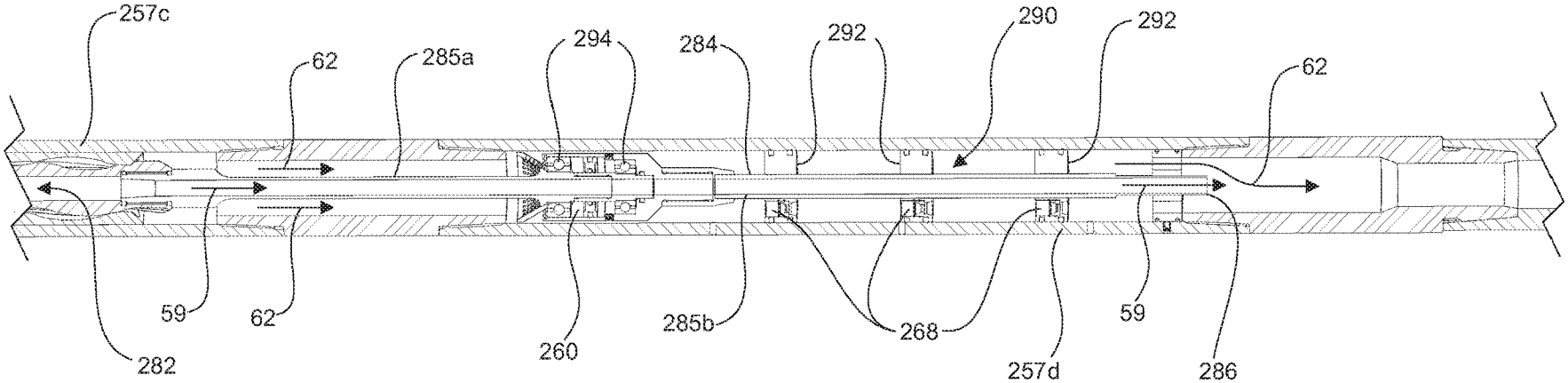
FIG. 12A is a cross-sectional view of a bottom portion of the torque generator shown in FIG. 11B, illustrating a rotary seal and nozzles therein, according to one embodiment.

The downhole end of the rotor 254 is fit with an extension tubular conduit 284 for directing bypass flow 59 from rotor bore 282 to a discharge end 286. As shown, the tubular conduit 284 has an uphole portion rotatable with the rotor 254 and drill string 14, and a downhole portion which may be rotatable with the torque generator housing 258. Between the uphole and downhole portions of the conduit 284 is a rotary seal 260 to maintain a pressure differential between the torque generator flow 62 outside the conduit 284 and the bypass flow 59 inside the conduit 284. With reference to FIG. 12A, the rotary seal 260 is configured to rotationally couple the uphole portion 285*a* of the conduit 284 with the downhole portion 285*b* of the conduit 284 such that the uphole portion 285*a*can rotate independently from the downhole portion 285*b*. In some embodiments, the rotary seal 260 has bearings 294 to allow the uphole portion 285*a* to rotate independently from the downhole portion 285*b*.

The second assembly comprises the torque generator housing 258 that extends from the uphole end adjacent the driveshaft connector 16. A downhole end of the torque generator housing 258 is connectable to an uphole end of the BHA housing. Thus, the torque generator housing may be considered as part of the BHA housing (i.e. an uphole portion of the BHA housing).

In some embodiments, the torque generator housing 258 comprises a complementary bearing housing 257*a*, a first tubular housing 257*b*, a stator housing 257*c*, and a second tubular housing 257*d*. In the illustrated embodiment, the torque generator housing 258 comprises, from the uphole end to the downhole end, the complementary bearing housing 257*a* for rotational coupling with the bearing pack 218; the first tubular housing 257*b* for housing the crossover 242; the stator housing 257*c* supporting the stator 256; and the second tubular housing 257*d* for defining a nozzle annulus 290 therein. The downhole end of the second tubular housing 257*d* is configured to be coupled downhole to the bent sub and drilling motor per that disclosed in the '839patent. The second assembly allows the BHA housing therebelow to rotate independently of the bearing pack 218 and thus the drill string 14.

Figure 12B:
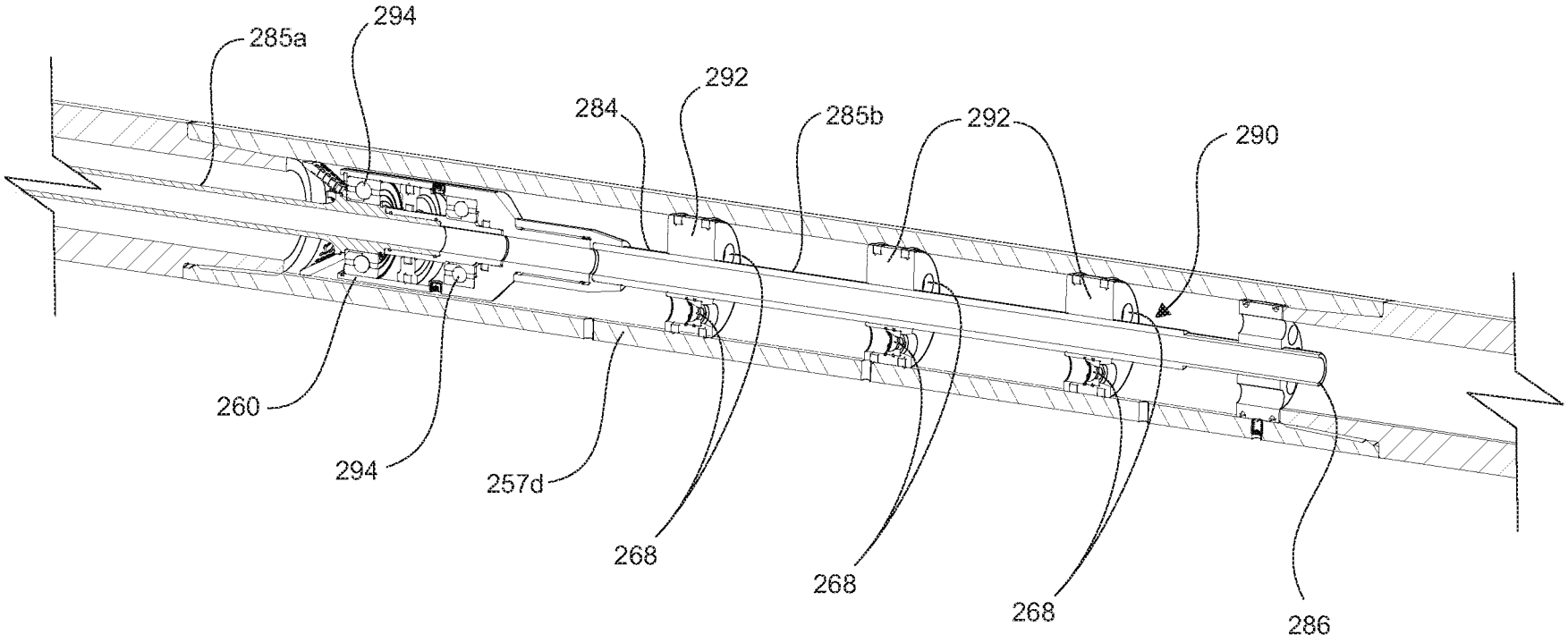
FIG. 12B is a perspective cross-sectional view of a bottom portion of the torque generator shown in FIG. 11B, showing more details of the rotary seal and nozzles therein, according to one embodiment.

The nozzle annulus 290 is formed between the torque generator housing 258 and the tubular conduit 284. One or more annular walls 292 are provided in the nozzle annulus 290, the annular walls being axially spaced apart from one another, and each annular wall 292 having one or more nozzles 268 therein for controlling the fluid pressure of the torque generator flow 62 passing therethrough. In a sample embodiment, FIG. 12B shows each annular wall 292 having at least two nozzles 268 therein. The at least two nozzles 268 in each annular wall 292 are arranged in parallel relative to one another. The combination of the tubular conduit and the one or more nozzles inside the nozzle annulus is referred to herein as a "pressure sub".

The nozzle annulus 290 is formed between the torque generator housing 258 and the tubular conduit 284. One or more annular walls 292 are provided in the nozzle annulus 290, the annular walls being axially spaced apart from one another, and each annular wall 292 having one or more nozzles 268 therein for controlling the fluid pressure of the torque generator flow 62 passing therethrough. The combination of the tubular conduit and the one or more nozzles inside the nozzle annulus is referred to herein as a "pressure sub".

The nozzle(s) 268 are selected at the surface before running the BHA 10, 50 into the well. The selection of the nozzle(s) 268 is based on, for example: an anticipated reactive torque generated by the mud motor 32 under a nominal weight-on-bit at an average formation density; a planned static drive speed for the drill string 14 during directional drilling and resulting counter torque generation at the planned static drive speed; and, an anticipated nominal mud density. The nozzle(s) 268 may be specially designed, or comprise one or more standard bit jet nozzles. The nozzle(s) 268 can be arranged in series in spaced annular walls 292 or parallel within an annular wall (for example, as shown in FIG. 12B), or both. In another embodiment, nozzle(s) 268 can be staged for adjusting the resistive torque of the generator 220, such staging generally reducing or preventing the flow and pressure drop of one nozzle from impacting or interfering other nozzles. For example, in the embodiment illustrated in FIG. 11B, the stage shown has three nozzles 268 arranged in parallel to produce a calculated pressure drop. The torque generator may have additional stages for producing prescribed pressure drops at different drill string rotational speeds. The configuration of the nozzles in each stage as well as the number of stages in the torque generator helps define the performance curve of the bottom-hole assembly.

In operation, drilling fluids are distributed from the drill string 14 to the bearing pack bore 219 via the driveshaft connector 16. The drilling fluids then flow to the crossover bore 243 from the bearing pack bore 219. The rotation of the rotor 254 caused by the rotation of the drill string generates suction in the pump chamber 280, which pumps some of the drilling fluids out from the crossover bore 243 into the housing annulus 259 via passages 244 and through pump chamber 280, while the remaining fluid in the crossover bore 243 flows through the rotor bore 282 to bypass the pump. The crossover 242 thus divides the drilling fluids into the torque generator flow 62 and the bypass flow 59 as the rotor 254 rotates. The torque generation flow 62 enters nozzle annulus 290 as a pressurized mud flow after it is pumped through the pump chamber 280. In the nozzle annulus 290, the torque generation flow 62 is forced through the one or more nozzles 268. At the discharge end 286, torque generator flow 62 discharged from the nozzle(s) 268 and the bypass flow 59 discharged from the conduit 284 recombine to power the drilling motor 32 downhole from the torque generator 220.

As the housing 258 and the tubular conduit 284 are contra-rotating, the annular walls 292 either pose as one or more differential rotational interfaces or the downhole portion of the conduit 284 is rendered rotational with the housing 258.

The torque generated by the torque generator 220 is regulated by controlling the rotational speed of the drill string 14. At the static drive speed, the drill string 14 induces the torque generator 220 to generate a torque that counterbalances a reactive torque generated by rotation of the drill bit 42 of the bottom-hole assembly as it turns against the bore hole and the bottom-hole assembly is rotationally stabilized to drill the nonlinear bore segment, whereas rotation of the drill string at a speed other than the static drive speed causes rotation of the bottom-hole assembly to drill the linear bore segment.

Figure 10B:
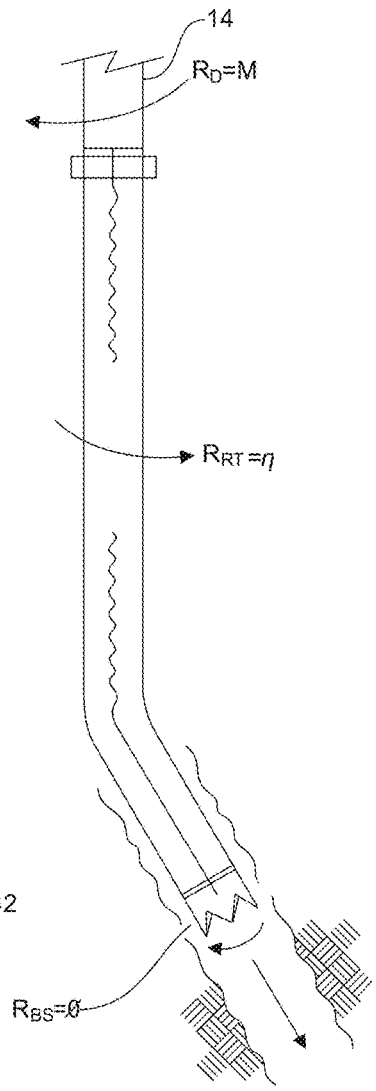
Figure 10C:
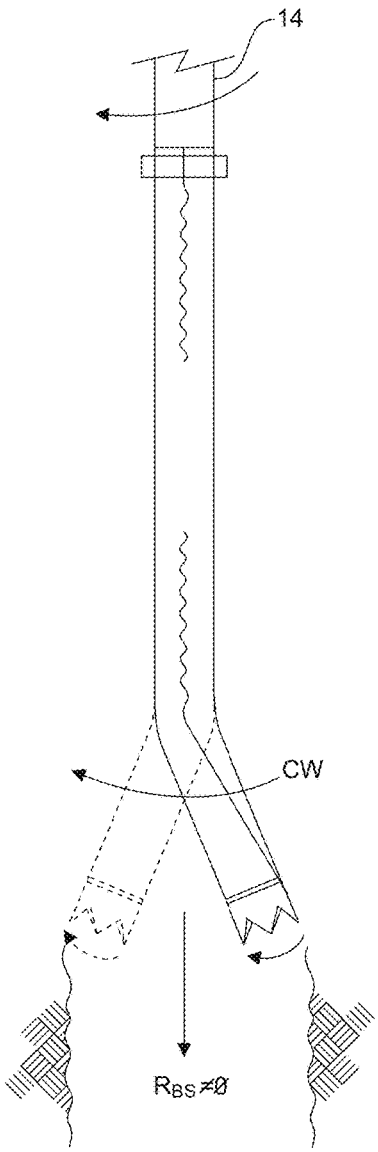

As would be understood, the present torque generator 220 is operative to provide means for improved control over directional drilling. FIG. 10A shows a general arrangement of the BHA 10 having the torque generator 220 and the drilling motor 32 for driving the drill bit 42. The drill string 14 is rotatable CW while the BHA is rotatable CCW. As illustrated in FIG. 10B, when the drill string CW rotation speed ($R_D$) is balanced with or equal to the reverse, CCW reactive rotation speed of the BHA ($R_{RT}$), the net rotation speed of the bent sub relative to the formation ($R_{BS}$) is neutral or zero for non-linear drilling. In other words, when $R_{RT}$ is at the static drive speed, $R_{BS}$ is zero. When $R_D$ is greater than $R_{RT}$, as illustrated in FIG. 10C, $R_{BS}$ is greater than zero for effecting linear drilling. When $R_D$ is less than $R_{RT}$, $R_{BS}$ is less than zero.

By way of example, if the torque generator 220 is underpowered, the entire BHA will rotate in one direction (relative to the drill string) with whatever torque is provided to the torque generator in the opposite direction. For example, it is contemplated that the BHA may be rotated CCW by overpowering the torque generator, and may be rotated CW by overpowering the drilling motor. For example, about 5,000 ft-lbs of torque by the torque generator and about 8,000 ft-lbs of torque at the drilling motor may result in rotation, at a certain speed, of the BHA CCW, or in the same direction as the drilling motor, because the torque generator is being overpowered. In the reverse scenario, 8000 ft-lbs of torque by the torque generator and 5,000 ft-lbs of torque at the drilling motor may result in rotation, at a certain speed, of the BHA CW, or in the opposite direction as the drilling motor, because the torque generator overpowers the drilling motor.

Accordingly to embodiments herein, alternative configurations of the torque generator 220 are possible. For example, the torque generator 220 may have a pressure sub between the crossover 242 and the positive displacement motor, such that the torque generator flow 62 passes through the nozzle(s) before reaching the positive displacement motor. The crossover bore 243 is fluidly connected to the rotor bore 282 via the tubular conduit such that the bypass flow 59 can flow from the crossover bore 243 into the rotor bore 282 via the tubular conduit, thereby bypassing the nozzle(s). In this sample configuration, the pressure sub creates a pressure differential across the positive displacement motor to generate torque. In some embodiments, the torque generator 220 comprises one pressure sub which may be positioned uphole or downhole from the pump. In other embodiments, the torque generator 220 has two or more pressure subs which may be positioned uphole and/or downhole from the pump. It would be understood that other alternative configurations are contemplated and encompassed herein.

In some embodiments, for example where the drill string includes a safety joint, the bearing pack 218 can be selectively rotationally locked (in other words, rotationally coupled) to the housing 258 or the pump. Rotationally locking the bearing pack 218 to the housing or the pump allows torque to be transferred to the safety joint for undoing same in the event that the tool becomes stuck in the wellbore during drilling.

For example, the selective rotational locking of the bearing pack may be accomplished by using a sprag clutch, which is a one-way freewheel clutch, as the bearing sub 222 or in addition to the bearing sub 222. The sprag clutch allows the torque generator to rotate in one direction, i.e. clockwise, but when the opposite rotation (i.e. counterclockwise) is applied, the sprag clutch locks the bearing pack 218 so it does not rotate relative to the housing 258 or the stator 256. Once the bearing pack is rotationally locked, mechanical (counterclockwise) torque can be transferred to the safety joint. As can be appreciated by those in the art, other ways of selectively rotationally locking the bearing pack are possible.

Therefore, an improved torque generator is provided for increased torque generation.

In one aspect, a torque generator is provided for use in a bottom-hole assembly comprising: a housing having a housing inner diameter; a bearing pack rotationally coupled to the housing, the bearing pack being connectable to a drill string and having a bearing pack bore extending therethrough for fluid communication with the drill string; and a pump inside and supported by the housing and having a pump chamber and a cross-sectional area which is maximized within the housing inner diameter; one or more nozzles inside and supported by the housing, downhole from the pump and in fluid communication with the pump chamber; a bypass conduit extending through the inside of the pump and bypassing the pump and the one or more nozzles, and having a discharge end downhole from the one or more nozzles; and a crossover having an inlet and two or more outlets, the inlet being in fluid communication with the bearing pack bore for receiving fluid therefrom, and at least one of the two or more outlets in fluid communication with the pump chamber for providing some of the fluid thereto, and the remaining outlets in fluid communication with the bypass conduit for providing the remaining fluid thereto.

In another aspect, a torque generator is provided for use in a bottom-hole assembly connectable to a drill string for drilling linear and nonlinear subterranean bore segments, and the torque generator comprises a first assembly and a second assembly. The first assembly is configured to be coupled to the drill string for rotation in a first direction, e.g. CW; and the second assembly is configured to be rotatable in a second direction, opposite the first direction, e.g. CCW. The second assembly allows part of the BHA therebelow (i.e. the BHA housing) to rotate in the second direction.

In some embodiments, the first assembly comprises: a bearing pack having a bearing pack bore extending therethrough for fluid communication with the drill string, the bearing pack being connectable to the drill string; a bearing sub coupled to the bearing pack; a crossover connected to a downhole end of the bearing pack and in communication with the bearing pack bore, the crossover having one or more passages for dividing fluid flowing therethrough into a torque generator flow and a bypass flow; a rotor connected to the crossover, the rotor having a rotor bore extending therethrough for passage of the bypass flow; and a tubular conduit connected to a downhole end of the rotor and in fluid communication with the rotor bore.

The second assembly comprises: a torque generator housing rotationally coupled to the bearing pack via the bearing sub; and a stator supported on the inner surface of the torque generator housing and having a diameter substantially the same as the inner diameter of the torque generator housing, and the rotor being positioned in the stator for operation therewith, wherein the torque generator housing assembly houses the crossover, the stator, the rotor, and the tubular conduit, wherein a pump chamber is defined between the rotor and the stator for passage of the torque generator flow, and wherein a nozzle annulus is defined between the torque generator housing and the tubular conduit.

In some embodiments, the first assembly and the second assembly are selectively rotationally lockable and unlockable relative to one another. For example, the first and second assemblies may be configured to allow the first assembly to rotate relative to the second assembly when a clockwise rotation is applied to the first assembly; however, when a counterclockwise rotation is applied to the first assembly, the first assembly is locked to the second assembly such that the first assembly does not rotate relative to the second assembly. Rotationally locking the first assembly relative to the second assembly allows the transfer of torque from the first assembly to the second assembly.

The torque generator further comprises one or more annular walls in the nozzle annulus and one or more nozzles in each annular wall for controlling a fluid pressure of the torque generator flow passing therethrough.

The torque generator permits the bottom-hole assembly to rotate independently of the bearing pack and the drill string.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the present invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A torque generator for use in a bottom-hole assembly, comprising:

a housing having a housing inner diameter;

a bearing pack rotationally coupled to the housing, the bearing pack being connectable to a drill string and having a bearing pack bore extending therethrough;

a pump having a pump chamber and a pump bore extending through the pump, the pump being inside and supported by the housing;

one or more nozzles inside and supported by the housing, and the one or more nozzles being in fluid communication with the pump chamber; and an extension conduit coupled to the pump, the extension conduit defining a flow path therethrough, the flow path being in fluid communication with the pump bore, wherein the flow path and the pump bore together define a bypass conduit to allow fluid to bypass the pump chamber and the one or more nozzles, the pump is positioned between the bearing pack and the one or more nozzles, and the bearing pack bore is in fluid communication with the pump bore and the pump chamber.

2. The torque generator of claim 1, wherein the pump has a cross-sectional area which is maximized within the housing inner diameter.

3. The torque generator of claim 1, further comprising a crossover having an inlet, a first outlet, and a second outlet, the inlet being in fluid communication with the bearing pack bore, the first outlet being in fluid communication with the pump chamber, and the second outlet being in fluid communication with the bypass conduit.

4. The torque generator of claim 3, wherein the first and second outlets are radial passages.

5. The torque generator of claim 1, wherein the pump is positive displacement motor comprising a rotor and a stator, the rotor being fit to the stator for operation therewith, and wherein the stator is supported by the housing and the rotor diameter is maximized within the housing.

6. The torque generator of claim 5, wherein the pump bore extends axially through the rotor.

7. The torque generator of claim 1, wherein the pump is a turbine motor or a progressive cavity pump.

8. The torque generator of claim 1, wherein the one or more nozzles are arranged in parallel.

9. The torque generator of claim 1, wherein the one or more nozzles are arranged in series.

10. The torque generator of claim 1, wherein a nozzle annulus is defined adjacent to the pump between an inner surface of the housing and an outer surface of the extension conduit, and the torque generator further comprises one or more annular walls in the nozzle annulus, and wherein the one or more nozzles are positioned in the one or more annular walls.

11. The torque generator of claim 1, wherein the bearing pack comprises a bearing sub for rotationally coupling the bearing pack with the housing.

12. The torque generator of claim 1, wherein the housing is positionable in an uphole portion of the bottom-hole assembly.

13. The torque generator of claim 1, wherein the extension conduit has a first portion and a second portion, the second portion being rotationally coupled to the first portion to allow the first portion to rotate independently from the second portion such that the first portion is rotatable with the drill string without rotating the second portion.

14. The torque generator of claim 13, further comprising a rotary seal for rotationally coupling the first portion with the second portion of the extension conduit.

15. A torque generator for use in a bottom-hole assembly connectable to a drill string, the torque generator comprising:

a first assembly comprising:

a bearing pack having a bearing sub and a bearing pack bore extending therethrough for fluid communication with the drill string, the bearing pack being connectable to the drill string;

a crossover connected to one end of the bearing pack and in communication with the bearing pack bore, the crossover having one or more passages for dividing fluid flowing therethrough into a torque generator flow and a bypass flow;

a rotor having a rotor bore extending therethrough for passage of the bypass flow; and a tubular conduit, a first portion of which is connected to one end of the rotor and the tubular conduit having defined therein a bypass conduit and the bypass conduit is in fluid communication with the rotor bore to receive the bypass flow;

a second assembly comprising:

a torque generator housing rotationally coupled to the bearing pack via the bearing sub; and a stator supported on the inner surface of the torque generator housing and having a diameter substantially the same as the inner diameter of the torque generator housing, and the rotor being positioned in the stator for operation therewith, wherein the torque generator housing houses the crossover, the stator, the rotor, and the tubular conduit, wherein a pump chamber is defined between the rotor and the stator for passage of the torque generator flow, and wherein a nozzle annulus is defined between the torque generator housing and the tubular conduit;

one or more annular walls in the nozzle annulus; and one or more nozzles in each annular wall for controlling a fluid pressure of the torque generator flow passing therethrough, wherein the bypass conduit bypasses the one or more nozzles.

16. The torque generator of claim 15, wherein the first assembly is rotatable in a first direction, and the second assembly is rotatable in a second direction independently of the drill string.

17. The torque generator of claim 15, wherein the one or more nozzles are arranged in parallel.

18. The torque generator of claim 15, wherein the one or more nozzles are arranged in series.

19. The torque generator of claim 15, wherein the housing is positionable in an uphole portion of the bottom-hole assembly.

20. The torque generator of claim 15, wherein the first portion of the tubular conduit is rotationally coupled to a second portion of the tubular conduit such that the first portion is rotatable independently from the second portion, and wherein the first portion is rotatable with the rotor and the drill string without rotating the second portion.

21. The torque generator of claim 20, further comprising a rotary seal for rotationally coupling the first portion with the second portion of the tubular conduit.

* * * * *